US007443953B1

(12) United States Patent
Yun et al.

(10) Patent No.: US 7,443,953 B1
(45) Date of Patent: Oct. 28, 2008

(54) STRUCTURED ANODE X-RAY SOURCE FOR X-RAY MICROSCOPY

(75) Inventors: Wenbing Yun, Walnut Creek, CA (US); Frederick W. Duewer, Albany, CA (US); Michael Feser, Martinez, CA (US); Andrei Tkachuk, Walnut Creek, CA (US); Srivatsan Seshadri, Walnut Creek, CA (US)

(73) Assignee: Xradia, Inc., Concord, CA (US)

( * ) Notice: Subject to any disclaimer, the term of this patent is extended or adjusted under 35 U.S.C. 154(b) by 13 days.

(21) Appl. No.: 11/609,266

(22) Filed: Dec. 11, 2006

Related U.S. Application Data

(60) Provisional application No. 60/749,493, filed on Dec. 9, 2005.

(51) Int. Cl.
*G21K 5/04* (2006.01)

(52) U.S. Cl. ..... 378/84; 378/156

(58) Field of Classification Search ..... 378/137–138, 378/84–85, 43, 143, 156
See application file for complete search history.

(56) References Cited

U.S. PATENT DOCUMENTS 7,180,981 B2 * 2/2007 Wang ..... 378/124
2001/0046276 A1 * 11/2001 Schneider et al. ..... 378/58
2003/0086533 A1 * 5/2003 Janik et al. ..... 378/138

OTHER PUBLICATIONS

Gstir, B., et al., "Calculated cross sections for the K-shell ionization of chromium, nickel, copper, scandium and vanadium using the DM formalism," Jour. Phys. B: At. Mol. Opt. Phys., 34, 3372-3382, 2001.
Goldstein, J. I., et al., Scanning Electron Microscopy and X-Ray Microanalysis, Plenum Press, New York, Chapter 3, 1992, nb pp. 76-78, 118-130, and 127-129.

* cited by examiner

*Primary Examiner*—Hoon Song
(74) *Attorney, Agent, or Firm*—Houston Eliseeva LLP

(57) ABSTRACT

An x-ray source comprises a structured anode that has a thin top layer made of the desired target material and a thick bottom layer made of low atomic number and low density materials with good thermal properties. In one example, the anode comprises a layer of copper with an optimal thickness deposited on a layer of beryllium or diamond substrate. This structured target design allows for the use of efficient high energy electrons for generation of characteristic x-rays per unit energy deposited in the top layer and the use of the bottom layer as a thermal sink. This anode design can be applied to substantially increase the brightness of stationary, rotating anode or other electron bombardment-based sources where brightness is defined as number of x-rays per unit area and unit solid angle emitted by a source and is a key figure of merit parameter for a source.

22 Claims, 4 Drawing Sheets

STRUCTURED ANODE X-RAY SOURCE FOR X-RAY MICROSCOPY

RELATED APPLICATIONS

This application claims the benefit under 35 U.S.C. 119(e) of U.S. Provisional Application No. 60/749,493, filed on Dec. 9, 2005 which is incorporated herein by reference in its entirety.

BACKGROUND OF THE INVENTION

X-ray microscopy is a technique that offers unique imaging through its combination of resolution, penetrating power, analytical sensitivity, compatibility with wet specimens, and ease of image interpretation. In the past, high resolution X-ray microscopy has been restricted to a few synchrotron radiation laboratories around the world. The emergence of laboratory source-based x-ray microscopes holds the opportunity to make this imaging modality much more widely available. Such laboratory-source x-ray microscopes, however, rely on the availability of high brightness x-ray sources for high performance.

Resolution and throughput are two important parameters defining the performance of a microscope. The former defines smallest features that can be imaged, while the later defines how fast useful information can be obtained. For a full field x-ray microscope, the exposure time T is inversely proportional to the flux F incident on the object:

$$F=\eta B_c L^2 \Delta\theta^2, \quad \text{(Ex. 1)}$$

where $B_c$, L, and $\Delta\theta$ are the beam brightness, the field of view, and the divergence of the illumination beam at the object, respectively; $\eta$ the efficiency of the focusing optics. Expression (1) shows that for a given field of view L, divergence $\Delta\theta$, focusing efficiency $\eta$, F is proportional to the source brightness $B_c$. Therefore, a brighter x-ray source means shorter exposure time and thus higher throughput.

A brighter x-ray source also permits higher resolution for a given exposure time. The dependence of exposure time T on resolution $\delta$ is approximately given by $$T=a/\delta^4, \quad \text{(Ex. 2)}$$

where "a" is a parameter independent of resolution and related to image contrast and the imaging system efficiency.

Expressions (1) and (2) show that for a given exposure time and imaging objective, the resolution can be improved by a factor of $B^{1/4}$ for a brighter source. This factor equals to 1.56 for a 6× brighter source.

The most widely deployed laboratory sources generate x-rays by bombarding energetic electrons into a target (anode), similar to how Roentgen first generated x-rays in his laboratory. The resulting x-rays consist of narrow-band characteristic x-rays resulting from ionization and de-excitation of core electrons and continuous Bremsstrahlung (braking) radiation resulting from the deceleration of the energetic electrons. Except for commercial x-ray applications requiring sources with a high intensity as the main requirement such as medical radiography and medical CT, or luggage scanners, a significant number of applications such as x-ray microscopy, protein crystallography, and small angle scattering, requires a source with high brightness for the characteristic x-rays.

The key limiting factor for increasing brightness of this type of source is the melting of the anode target. Two well-established approaches have been developed to overcome this limitation and are used in current high brightness laboratory x-rays sources. The first method facilitates thermal dissipation by using a fast rotating anode target to distribute the heat flux over a large area to prevent the target from melting. X-ray sources based on this method constitute the most powerful x-ray sources widely used in a home-lab environment. The second method uses a micro-sized electron spot (microfocus source) to reduce the thermal path to produce a large thermal gradient for better thermal dissipation.

Several other approaches have been explored in recent years to produce high brightness laboratory x-ray sources. One method involves innovations based on various forms of accelerator-based technologies and two miniature synchrotron sources have been demonstrated recently. The accelerator and miniature synchrotron sources are currently expensive. Another method uses a high power laser beam focused to a small spot on a target to produce high temperature plasmas that emit high brightness x-rays. However, this method is limited to soft x-rays and not well suited for multi-kiloelectron Volts (KeV) x-rays that are desired for most for imaging.

SUMMARY OF THE INVENTION

The present invention concerns an x-ray source, anode target design and x-ray microscope. The designs are based on the realization that the effectiveness (yield) of high energy electrons in producing characteristic x-rays decreases rapidly with decreasing energy. In the standard configuration of an x-ray source, all the energy of the energetic electrons including inefficient lower energy ones are deposited in the target within a small interaction volume.

Embodiments of the present invention include a structured anode that has a thin top layer made of the desired target material and a thick bottom layer made of low atomic number and low density materials with good thermal properties. This structured target design allows for the use of efficient high energy electrons for the efficient generation of characteristic x-rays per unit energy deposited in the top layer and the use of the bottom layer as a thermal sink. This anode design can be applied to substantially increase the brightness of stationary, rotating anode or other electron bombardment-based sources where brightness is defined as number of x-rays per unit area and unit solid angle emitted by a source and is a key figure of merit for a source.

In one example, the anode comprises a target layer of copper with an optimal thickness deposited on a substrate layer of beryllium or carbon/diamond substrate. In other examples, the target layer is chromium, tungsten, platinum, or gold. This target will used to replace the anode in a commercially available x-ray source.

The present source can substantially improve the performance of many well established x-ray techniques, including x-ray microscopy, protein crystallography for determination of crystallographic structures of proteins and viruses, and small angle scattering for studying macromolecules in native solution.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1A:
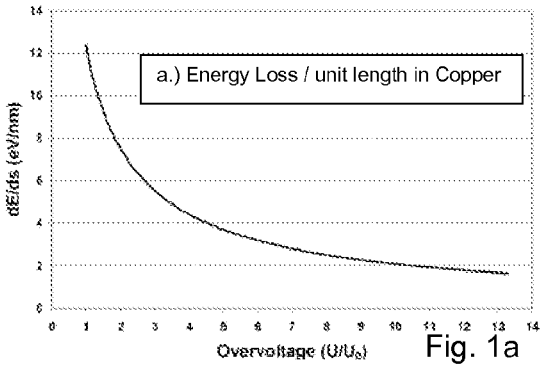
FIG. 1*a* is a plot of electron energy loss per unit path length as a function of overvoltage U/U0 calculated with the Bethe Continuous Electron Energy Loss.

Roentgen discovered in 1896 that when energetic electrons hit a target, x-rays are generated. This basic principle is still used in almost all commercial laboratory x-ray sources. The generated x-rays do not all have the same energy (and equivalently wavelength), but have a spectral distribution that contains a broad Bremsstrahlung (braking radiation) component and very narrow x-ray spectral lines known as the characteristic radiation. Many applications use the combined x-ray output e.g. medical radiography. However, applications that require strictly quasi-monochromatic (single wavelength) x-rays can only use the narrow x-ray lines of the characteristic radiation. For these applications, which include x-ray diffraction, small angle scattering, or x-ray microscopy using zone plates, the Bremsstrahlung component yields unwanted background and is suppressed by energy filtering or eliminated by monochromators. The following discussions only focus on characteristic x-ray radiation, and only on a particular x-ray fluorescence line of interest, e.g. CuKα. The energy (or wavelength) of the characteristic radiation is dependent on the target anode material. For example a copper anode will emit Cu—Kα radiation at an energy of 8.05 KeV (or wavelength of 1.54 Å) if bombarded with electrons of energy greater than 8.98 KeV, the critical excitation energy.

The source brightness B is the most important figure of merit for an x-ray source for many x-ray techniques that include x-ray microscopy, diffraction, and small angle scattering. The source brightness is proportional to the x-ray flux F of the characteristic radiation emitted, and inversely proportional to the source area A, from which x-rays are emitted:

$$B \propto \frac{\phi}{A} \tag{Ex 3}$$

where $\phi \alpha P \equiv IU$ and P is the Power loading

Expression (3) shows that a high brightness source requires a lot of x-rays to be generated over a small area. In existing high brightness electron bombardment based x-ray sources, development efforts have been focused on increasing electron current density and optimizing x-ray production by optimizing electron energy. It has been found that the optimal electron beam energy U is in the range of 3-6 times the atomic shell ionization energy $U_0$ of the characteristic x-ray line. The parameter $U/U_0$ is called the overvoltage and is a convenient dimensionless parameter to use. The exact optimum choice of overvoltage depends heavily on the target material, the take-off angle of the x-rays and the self absorption within the target. Accepting the optimum value of the overvoltage which fixes the x-ray yield for a given current, the brightness of a conventional source is determined by the current density I/A, as the generation of x-rays is proportional to number of electrons:

$$B_{Solid}\left(\frac{U}{U_0} = \text{Constant}\right) \alpha \frac{P}{A} \tag{Ex 4}$$

The practical limit to the increase of the electron beam current density is the melting of the target anode due to heat deposited by the electron beam, or in some cases such as Cr, the sublimation temperature which further limits the electron beam current. It is known that the allowable electron beam power increases linearly with the electron spot diameter, which favors small spot sizes for high brightness. To reduce the problem of thermal load, modern sources operate either at a low (~6-15 degrees) take-off angle (micro-focus sources) to allow spreading the electron beam heat load along a line or they use a rotating anode target to spread the heat load over a line on the rotating cylinder surface.

While the rotating anode typically produces a much larger total x-ray flux, microfocus x-ray sources can be substantially brighter than rotating anode sources due to a small source spot. For example, the maximum thermal loading of a widely deployed rotating anode is quoted as 1.2 kiloWatts (kW) over an electron spot size of 100 micrometers and that of a microfocus x-ray source is quoted 5 W and 10 W over an electron spot size of 4 and 7 micrometers, respectively. This corresponds to relative brightness of 0.12, 0.3 and 0.2 W/μm$^2$ respectively.

Figure 1B:
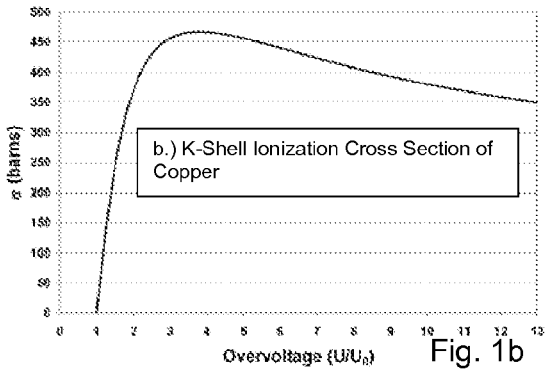
FIG. 1*b* is a plot of K-shell ionization cross section of Copper as a function of overvoltage U/U0 (the ionization cross section is proportional to the characteristic x-ray generation per unit path length)
Figure 1C:
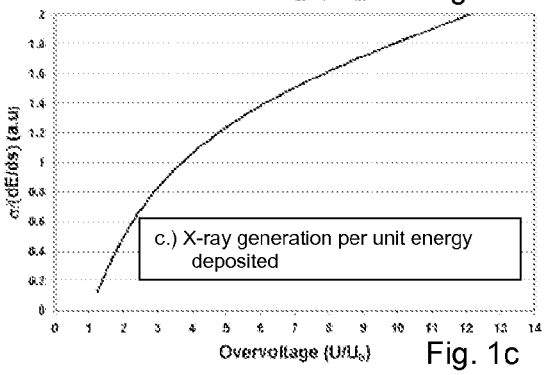
FIG. 1*c* is a plot of the ratio of x-ray generation and energy loss per unit path length as a function of overvoltage in arbitrary units (this ratio is obtained by dividing the ionization cross section (FIG. 1*b*) by the differential energy loss (FIG. 1*a*))

Accepting that the thermal load constitutes the practical limit for the electron beam current density, a solution has to be sought by minimizing the heat load in the target and maximizing the x-ray yield for a given thermal load. FIG. 1(*a*) shows clearly, for the example of a copper target, that for electrons with low overvoltages a lot of heat is dissipated in the target per unit path length. However, the x-ray generation per unit path length, which is proportional to the ionization cross section, as depicted in FIG. 1(*b*) shows that the x-ray generation is fairly constant even at high overvoltages. This is summarized in FIG. 1(*c*), which illustrates that the x-ray generation per unit energy deposited increases monotonically as a function of overvoltage. However, for a conventional solid, uniform target this fact cannot be utilized.

The preferred embodiment of the present invention utilizes high overvoltages to minimize heat generation in the target for equivalent x-ray output and a micrometer size excitation spot to maximize the brightness of the x-ray source. Specifically, in the preferred embodiment, the electron beam energy U is more than 6 times the atomic shell ionization energy $U_0$ of the characteristic x-ray line of interest. In the preferred embodiment electron beam energy U is more than 8-10 times the atomic shell ionization energy $U_0$ and can be as high as 15 or more in some embodiments.

Figure 2B:
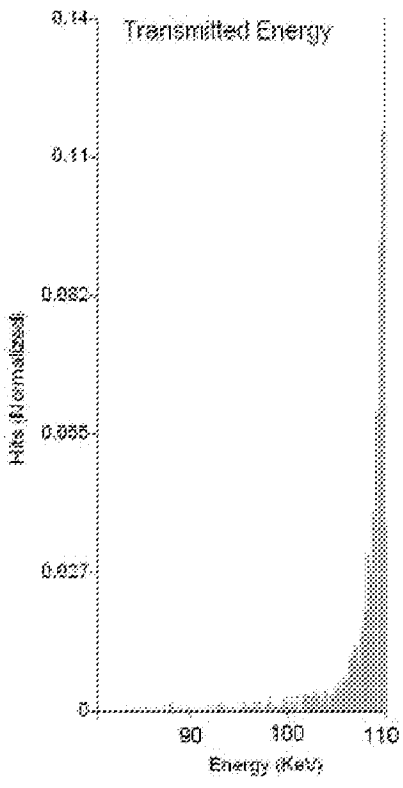
FIG. 2*b* is a simulation of the distribution of energies of electrons of 120 KeV kinetic energy that are transmitted through a 4 μm thick copper target according to an embodiment of the present invention.
Figure 2A:
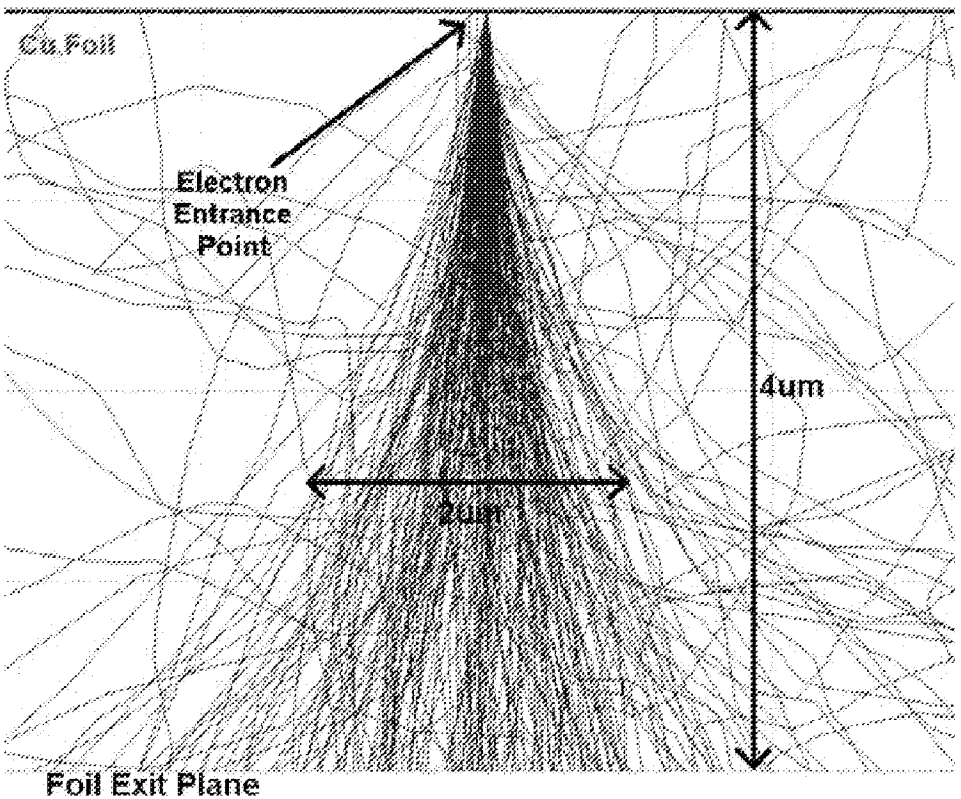
FIG. 2*a* is a Monte Carlo simulation of the trajectory of electrons with 120 KeV kinetic energy in a 4 micrometer (μm) thick copper film according to an embodiment of the present invention.

To only use high overvoltages, the chosen target anode material must be a thin foil. In this case, the electrons lose only a small amount of energy after transmission through the foil. This is illustrated in FIG. 2*a* with the example of a 4 micrometer (μm) thick copper foil that is struck by electrons of 120 KeV energy. As shown in the energy distribution of the transmitted electrons in FIG. 2*b*, the average energy loss of the electrons is only 10% in the Copper foil. Therefore the ratio of x-ray generation versus heat generation is 10 times higher than for low overvoltages (cf. FIG. 1*c*). As can be seen, the cross section rises rapidly over the ionization threshold and then drops off very gradually towards high overvoltages.

The additional benefit of a thin foil is that the electrons stay tightly collimated, opening only to a full width half maximum (FWHM) of 2 μm due to scattering when exiting the foil, which satisfies the requirement for a high brightness source.

On the other hand, it is clear that a thin foil target by itself dissipates heat quite poorly, so a "heat sink" that is in intimate contact to the copper foil is provided. The requirements for this "heat sink" are: 1) very weak interaction with the electron beam to minimize heating and spread the energy of the transmitted electrons over a large volume; 2) high heat conductivity to efficiently remove the heat from the copper foil and the residual heat generated from the electrons inside the "heat sink" itself; 3) good x-ray transmission for the x-ray line of the primary anode target foil (if used in a transmission source geometry); and 4) poor x-ray generation efficiency of the "heat sink" itself, which would contribute to the background x-rays.

In one embodiment, beryllium is used as the substrate for the foil target since this element provides a good fit and compromise for all of these requirements. In another embodiment, diamond (crystallized carbon) is used as the substrate since it offers superior melting point and thermal conductivity properties. The table shows the melting points and thermal conductivity at room temperature of copper, beryllium and diamond.

TABLE 1

Melting points and thermal conductivity of materials

| | Melting Point in (° C.) | Thermal Conductivity at room temperature (W/cm/K) |
|---|---|---|
| Beryllium | 1287 | 2.01 |
| Copper | 1085 | 4.01 |
| Diamond | 4440 | 11 |

It is recognized that Copper and Beryllium require an additional, thin (~20 nanometer (nm)) diffusion barrier material such as Titanium, Chromium or Tungsten between them to prevent the formation of alloys. But this will not impact the thermal properties of the structured target.

Figure 3:
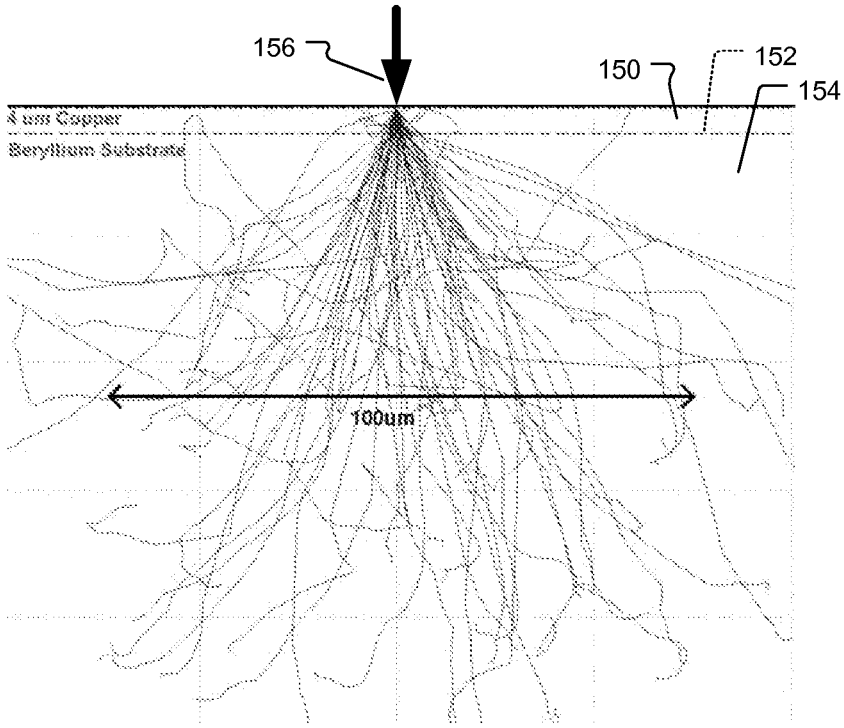
FIG. 3 shows the results of a simulation of 120 KeV electrons penetrating a structured target of 4 μm copper backed by a thick Be substrate showing how the electrons that are transmitted through the copper dissipate their energy in a large volume inside the Be and are essentially not backscattered into the copper layer according to an embodiment of the present invention.

FIG. 3 shows a simulation of electron trajectories from electron beam 156 for a 4 μm copper foil target 150 in intimate contact with a thick Beryllium substrate 154, with an optional intervening barrier layer 152. It can be seen that the electrons that leave the copper foil 150 generally do not return, because of the low backscattering in the beryllium substrate 154. Therefore, the tight collimation of the electrons in the copper foil 150 is preserved. Secondly, the differential energy loss in the beryllium is small resulting in a deep penetration into the beryllium spreading the residual kinetic energy of the electrons over a large interaction volume (sphere ~100 μm diameter).

The foregoing assumes that the continuum radiation is minimized which is an additional advantage of the proposed x-ray source. Firstly, as opposed to a thick solid target of conventional sources, the thin film of copper 150 in which only about 10% of the electron energy is deposited, minimizes the production of the continuum radiation. Secondly from Kramer's law, we know that the continuum is directly proportional to Z. Since beryllium has a very low atomic number (Z=4), production of continuum radiation by the thick beryllium substrate 154 is smaller by about a factor of 7 as compared to a thick Copper target. The spectral output then would have a significant peak to continuum ratio as compared to conventional targets.

Figure 4:
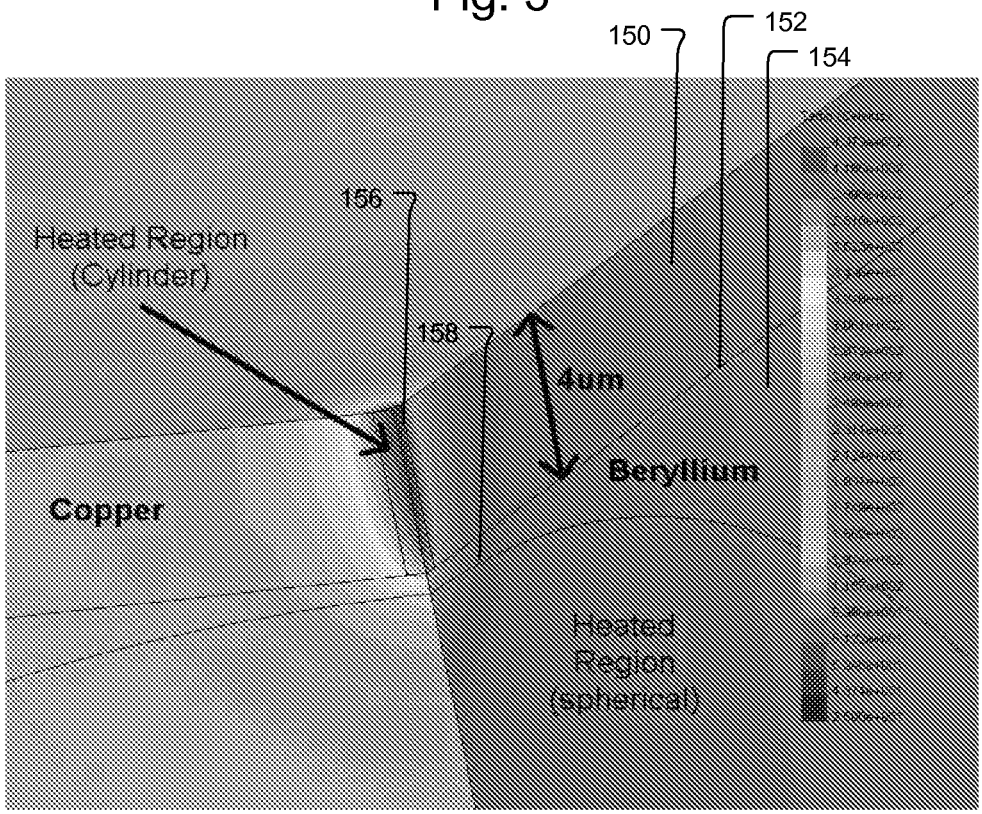
FIG. 4 is a thermal equilibrium calculation simulating a structured target with 4 μm copper film thickness on a 250 μm thick Beryllium support and a 8 Watt (W) focused electron beam with 120 KeV energy (the Cu/Be target is assumed to be cooled by a heat reservoir at 25° C. far away from the interaction volume; the heated regions have been approximated by a cylinder in the copper region and by a sphere in the beryllium region (for clarity, only one quadrant of the Cu/Be target is shown)

FIG. 4 shows finite element analysis results, which assume an incident electron beam power of 8 W of which 0.8 W dissipate in the 4 μm copper layer and 7.2 W dissipate in the beryllium. The heated shapes have been assumed to be a cylinder 156 with 2 μm diameter in the copper 150 and a sphere 150 with diameter 100 μm in the beryllium 154. Under the simulated conditions the highest temperature reached in the system is 437 degree Centigrade, approximately half the melting point temperature of copper.

To compute the generated x-ray flux, one can use empirical formulae for solid and thin targets respectively or alternatively use a Monte-Carlo simulation for both cases. If one considers a Copper target, the calculations show that for a given electron beam current, the generated x-ray flux is approximately the same for a solid Copper target bombarded with 40 KeV electrons and a 4 μm thick Copper target bombarded with 120 KeV electrons.

The table below compares the allowable operating parameters of a conventional Copper microfocus x-ray source with the proposed structured target.

TABLE 2

| Target Type | Solid Copper Target | 4 um Copper/ Beryllium backing |
|---|---|---|
| Electron Beam Energy | 40 KeV | 120 KeV |
| Maximum Linear Power Loading[2] | 0.4 W/um | 4 W/um |
| Source Size Achievable | 4 um | 2 um |
| Maximum Power For Spot Size | 1.6 W | 8 W |
| Maximum Electron Current | 40 uA | 66 um |
| Relative X-ray Brightness[1] | 2.5 | 16.5 |

[1]This is given as the ratio of the electron current and x-ray focal spot area. It has been shown with empirical calculations and Monte-Carlo simulations that under these two target/beam conditions the generated x-ray output is the same for a given electron beam current.

[2]Maximum heating power per linear micrometer that can be tolerated by the target. It results in a maximum temperature increase to half the melting point of Copper.

The important conclusion from this calculation is that the maximum x-ray brightness of the source corresponds directly to the highest electron beam current density that can be supported by the target.

This comparison shows that a brightness increase of more than a factor of 6 can be expected with the proposed structured target.

A structured target as shown in FIG. 3 comprises a top layer of Copper 150 with a thickness of 1-8 μm and preferably about 3-5 μm and a bottom layer made of a beryllium or diamond of about 100 to 1000 μm and preferably about 200 to 300 μm. The copper thickness corresponds to the depth that 120 KeV electrons lose about 5-15% or about 10% of its energy. Thus different energies or targets would yield different target layer thicknesses. The beryllium or diamond thickness is sufficiently thick to stop all the electrons and has negligible absorption of the Cu Ka x-rays. The thin barrier layer 152 is preferably added between the target material and the substrate material.

To obtain optimum source brightness, the copper film has a high thermal conductivity close to its bulk value. Depending on deposition method and conditions of the Cu film, the thermal conductivity can change by up to 25%. Film deposited by sputtering offers the highest attainable film densities and thus higher thermal conductivity. Although various methods are preferably used to optimize the thermal conductivity, such as annealing and ion assisted sputtering.

Both beryllium and diamond are good candidates for the bottom layer. Beryllium is a low atomic number and low mass density material and has reasonably good thermal conductivity and relatively high melting point. Diamond is also a low atomic number and low mass density material but has much higher thermal conductivity and melting point. However, beryllium foil with the required thickness is more cost effective than a comparable diamond foil.

Preventing diffusion and alloying of copper and beryllium is an important reliability issue for the proposed structured target. Alloying between beryllium and copper will decrease the attainable power loading by reducing both the melting point and thermal conductivity of the target region whose values are given in Table 1. In the preferred embodiment, a thin barrier layer is deposited between the beryllium and copper, such as Cr or Ti.

The electron beam preferably has the following characteristics: acceleration voltage greater than 80 and preferably greater than 100-120 kV, focal spot size of less than 5 μm, and preferably less than about 2-3 μm, beam current less than 60 microAmperes (μA).

Figure 5:
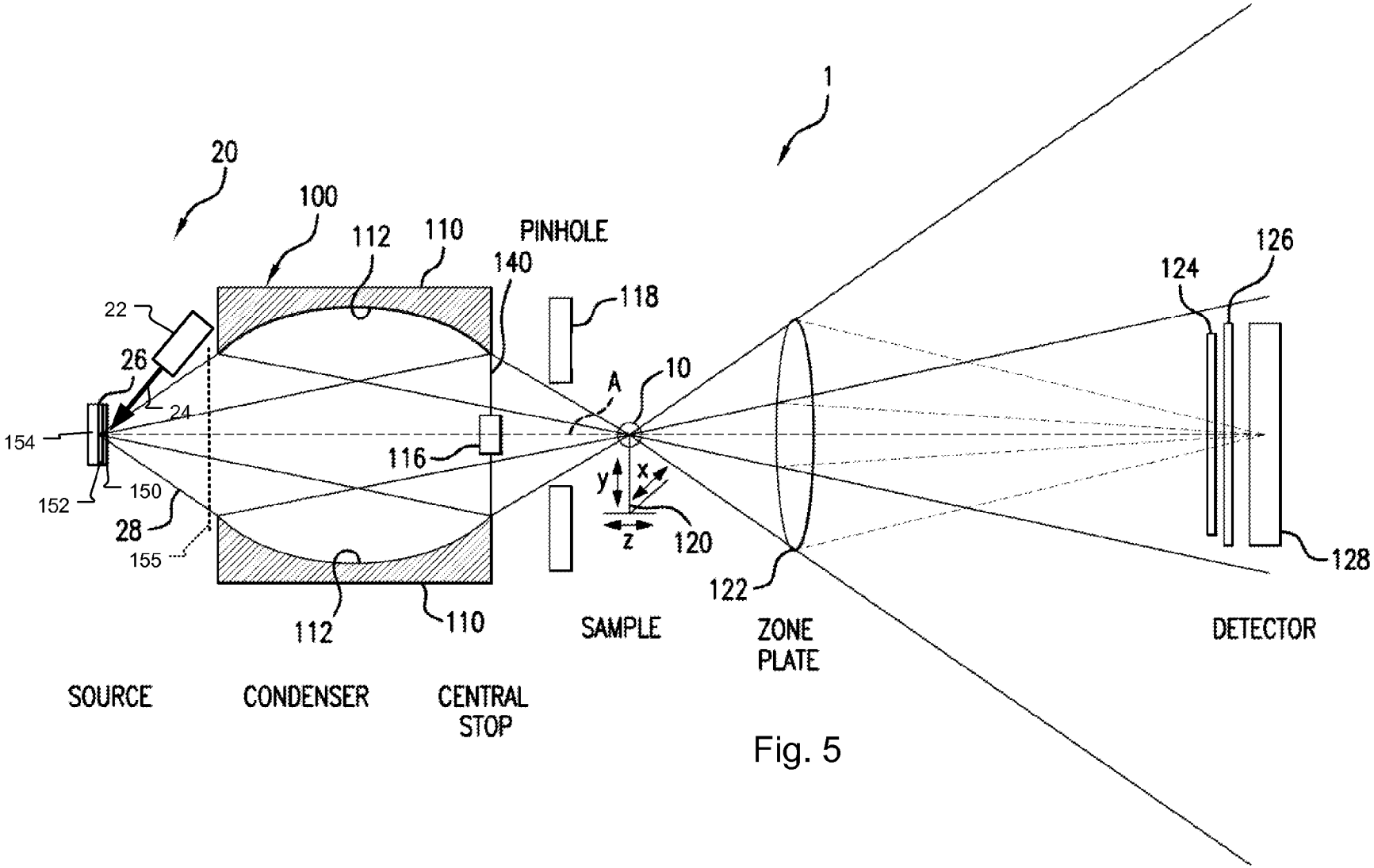
FIG. 5 is a schematic side view of an inventive full field x-ray transmission microscope using the x-ray source.

FIG. 5 is a schematic diagram of an X-ray microscope 1 using a x-ray source, which has been constructed according to the principles of the present invention.

Specifically, in the current embodiment, the electron bombardment laboratory X-ray source 20 comprises an electron gun 22 that generates an electron beam 24, as described above, that is directed at the target 26. The target 26 is as describe above having a thin copper target layer 150. In other embodiments, the target layer is selected from the group of: chromium, tungsten, platinum, or gold. The target 26 also comprises a low Z material substrate such a beryllium or carbon (diamond). The barrier layer 152 is also used in some embodiments.

This bombardment of the target 26 generates X-ray radiation 28 by the process of x-ray fluorescence. The radiation is emitted, typically at a 6-45 degree, take-off angle.

A condenser system 100 preferably provided, such as a capillary tube-based system. In some example, a monochromator 155 is added to reduce background radiation levels.

The radiation is converted into a converging cone of radiation, directed at the sample 10. The sample 10 is preferably held on a stage 120, which allows for its controlled positioning along the optical axis A, or z-axis direction, and the x and y axes, which are orthogonal to the optical axis A.

Some of the radiation is absorbed, phase-shifted, or diffracted in the sample, whereas other radiation is transmitted completely through the sample 10. The transmitted radiation is received at a zone plate lens 122. This zone plate collects the diverging cone of radiation, and converts it into a converging hollow cone of radiation in the direction of a detector 128.

In the typical embodiment, an intervening scintillator 124 and optical system 126 are used. Generally, the scintillator 124 is required when the detector 128 was not responsive to the radiation generated by the source. This is especially common for shorter wavelength X-rays and hard X-rays. Charge coupled devices (CCDs) are not responsive to this form of radiation since it will pass entirely through the device. As a result, the scintillator 124 generates radiation in the optical wavelengths, which are then focused or imaged by the optical system 126 onto the detector 128, such as a CCD or film.

In zone plate systems, the radiation that is used to illuminate the sample 10 preferably has a hollow cone profile. That is, there is substantially no radiation being transmitted along the optical axis A. This is because zone plates are only approximately 20% efficient in diffracting radiation to the detector. Thus radiation traveling along the optical axis is dominated by undiffracted radiation, which carries little information about the sample 10. As a result, in the preferred embodiment, a center stop 116 is located between the source 10 and the detector 128. Preferably the center stop is located near or in the capillary optic 110. In the preferred embodiment, it is located at the capillary optics exit aperture.

In the preferred embodiment, the center stop 116 is attached to a membrane 140, which is transmissive to radiation, such as silicon nitride. This silicon nitride membrane is then adhered or bonded to the exit aperture of the capillary tube 110.

To further improve the signal to noise ratio, a pinhole aperture 118 is preferably provided between the source 10 and the detector 128 to further decrease system background radiation.

The pinhole stop 118 is preferably located on a separate stage. In an embodiment, the capillary optic is approximately 3 millimeters (mm) in diameter. The exit aperture is approximately 200 micrometers in diameter.

The numerical aperture of the condenser 110 preferably matched to the zone plate lens. The zone plate lens is thus fully filled and therefore, efficiently used.

In still other implementations, where the source size is smaller than the field of view of the x-ray microscope, the condenser is used in a magnifying geometry to achieve suitable illumination of the object. This design allows the use of a source with a small source size which typically provides higher source brightness and thus typically higher throughput.

While this invention has been particularly shown and described with references to preferred embodiments thereof, it will be understood by those skilled in the art that various changes in form and details may be made therein without departing from the scope of the invention encompassed by the appended claims.

What is claimed is:

1. An x-ray source comprising:

an electron source for generating an electron beam;

an anode, at which the electron beam is directed to produce x-rays, the anode comprising a layer of a metal on a substrate, the metal layer being less than 8 micrometers thick;

a monochromator for suppressing Bremsstrahlung radiation in the x-rays relative to x-ray radiation of a characteristic line of the metal; and a central stop for spatially filtering the x-rays.

2. An x-ray source as claimed in claim 1, wherein the metal layer of the anode is thin, being less than 3-5 micrometers thick.

3. An x-ray source as claimed in claim 1, wherein the metal layer comprises copper.

4. An x-ray source as claimed in claim 1, wherein the metal layer comprises chromium, tungsten, platinum, or gold.

5. An x-ray source as claimed in claim 1, wherein the substrate comprises beryllium.

6. An x-ray source as claimed in claim 1, wherein the substrate comprises carbon.

7. An x-ray source as claimed in claim 1, wherein the substrate comprises diamond.

8. An x-ray source as claimed in claim 1, further comprising a barrier layer between the metal layer and the substrate.

9. An x-ray source as claimed in claim 1, wherein a thickness of the metal layer is selected based on an acceleration voltage of the electron beam such that electrons lose only about 5-15% of their energy in the metal layer.

10. An x-ray source as claimed in claim 1, wherein an energy of the electron beam more than 8 times an atomic shell ionization energy of the metal layer.

11. An x-ray source as claimed in claim 1, wherein an energy of the electron beam about 15 times an atomic shell ionization energy of the metal layer, or more.

12. An x-ray source as claimed in claim 1, further comprising a pin hole aperture.

13. An x-ray source as claimed in claim 1, wherein the x-rays are collected at a take-off angle of 6-45 degree relative to the layer of the metal.

14. An x-ray source as claimed in claim 1, wherein a focal spot size of the electron beam on the metal layer is less than 5 micrometers.

15. A method for generating x-rays, comprising:

generating an electron beam;

directing the electron beam at a metal layer to generate x-rays, the metal layer being less than 8 micrometers thick;

filtering the x-rays to suppress Bremsstrahlung radiation relative to x-ray radiation of a characteristic line of the metal; and spatially filtering the x-rays with a central stop.

16. A method as claimed in claim 15, wherein the metal layer is less than 3 micrometers thick.

17. A method as claimed in claim 15, wherein an energy of the electron beam is more than 8 times an atomic shell ionization energy of the metal layer.

18. A method as claimed in claim 15, wherein an energy of the electron beam is about 15 times an atomic shell ionization energy of the metal layer, or more.

19. A method as claimed in claim 15, wherein the step of filtering comprises using a monochromator.

20. A method as claimed in claim 15, further comprising spatially filtering the x-rays with a pin hole aperture.

21. A method as claimed in claim 15, further comprising collecting the x-rays at a take-off angle of 6-45 degree relative to the layer of the metal.

22. A method as claimed in claim 15, wherein a focal spot size of the electron beam on the metal layer is less than 5 micrometers.

* * * * *